US005961038A

United States Patent [19]

Okada

[11] Patent Number: 5,961,038

[45] **Date of Patent: *Oct. 5, 1999**

[54] THERMAL TYPE EXPANSION VALVE

[75] Inventor: Satoru Okada, Hashima, Japan

[73] Assignee: Pacific Industrial Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/678,249

[22] Filed: Jul. 11, 1996

[30] Foreign Application Priority Data

Jul. 13, 1995 [JP] Japan ..... 7-201754

[51] Int. Cl.[6] ..... F25B 41/04

[52] U.S. Cl. ..... 236/92 B; 62/225

[58] Field of Search ..... 62/225; 236/92 B

[56] References Cited

U.S. PATENT DOCUMENTS

| | | | |
|---|---|---|---|
| 2,605,050 | 7/1952 | MacDougall | 236/92 |
| 3,388,864 | 6/1968 | Noakes | 236/92 |
| 4,245,667 | 1/1981 | Braukmann | 137/493 |
| 4,819,443 | 4/1989 | Watanabe et al. | 62/225 |

FOREIGN PATENT DOCUMENTS

| | | |
|---|---|---|
| 2-187579 | 1/1989 | Japan . |
| 5-322380 | 5/1992 | Japan . |
| 6-185833 | 12/1992 | Japan . |

OTHER PUBLICATIONS

Application No. 92106896.1 Date Nov. 11, 1992, filing date Apr. 22, 1992, inventor Hirota, country EPX.

Application No. 93105697.2 date Feb. 16, 1994, filing date Apr. 6, 1993, inventor Rafeld, country EPX.

Application No. 95119999.1 date Jun. 26, 1996, filing date Dec. 18, 1995, inventor Modiano, country EPX.

Application No. JP930056635 date Sep. 30, 1994, filing date Mar. 17, 1993, inventor Iwao, country JPX.

*Primary Examiner*—William E. Tapolcai

*Attorney, Agent, or Firm*—Marger Johnson & McCollom, P.C.

[57] ABSTRACT

An expansion valve includes a valve body, an adjusting mechanism for adjusting a flow rate of a refrigerant supplied to an evaporator and a control mechanism for controlling said adjusting mechanism in accordance with a temperature of the refrigerant supplied to a compressor from the evaporator. The body has a first passage for introducing the refrigerant to the body, a second passage for supplying the refrigerant from the first passage to the evaporator and a third passage for transferring the refrigerant to the compressor from the evaporator. The adjusting mechanism has a restriction for connecting the first passage with the second passage and a valve member for adjusting a degree of the restriction. The control mechanism has a heat sensitive chamber filled with the gas in a sealing manner and a diaphragm movable in accordance with pressure in the sensitive chamber. A transmitting member transmits the temperature of the refrigerant flowing in the third passage to the gas in the sensitive chamber and the movement of the diaphragm to the valve member. The body is made of a synthetic resin. A metal member is disposed in the body between the first passage and the second passage. The metal member has the restriction and a valve seat for contacting the valve member.

19 Claims, 4 Drawing Sheets

THERMAL TYPE EXPANSION VALVE

BACKGROUND OF THE INVENTION

1. Field of the Invention

The present invention relates to a thermal type expansion valve for a refrigerating circuit of an air-conditioning apparatus, and more particularly, to a thermal type expansion valve that adjusts the flow rate of refrigerant conveyed to an evaporator in accordance with the temperature of the refrigerant discharged from the evaporator toward a compressor.

2. Description of the Related Art

A cross-sectional view of a prior art thermal type expansion valve 4, which is installed in a refrigerating circuit of an automobile air-conditioning apparatus, is illustrated in FIG. 4. The air-conditioning apparatus includes a compressor 1, a condenser 2, a receiver 3, the expansion valve 4, and an evaporator 5.

The compressor 1 is operably connected to an engine by an electromagnetic clutch (not shown) and driven by the rotational force of the engine. The compressor 1 compresses gasified refrigerant sent from the evaporator 5. The condenser 2 then condenses the high temperature, high pressure refrigerant gas through heat exchange with air from outside the automobile and liquefies the refrigerant. The receiver 3 receives and temporarily reserves the liquefied refrigerant cooled by the condenser 2. The receiver 3 incorporates a drier (not shown) to remove moisture and particulate matter from the refrigerant. The expansion valve 4 expands the liquefied refrigerant sent from the receiver 3. This lowers the temperature and pressure of the refrigerant and atomizes the refrigerant. The atomized refrigerant from the expansion valve is vaporized by the evaporator 5 through heat exchange with air sent into a passenger compartment of the automobile.

As shown in FIG. 4, the prior art expansion valve 4 includes a metal main body 6 having a rectangular parallelopiped shape. The main body 6 is provided with a first passage 7, which is connected with the outlet of the condenser 2 via the receiver 3, a second passage 8, which is connected to the inlet of the evaporator 5, and a third passage 9, which connects the outlet of the evaporator 5 with the inlet of the compressor 1. A restricting mechanism 13 is arranged inside the first passage 7.

The restricting mechanism 13 includes an orifice 25, a valve member 27, and a coil spring 29. The orifice 25 is formed in the main body 6 to connect the first passage 7 with the second passage 8. The inlet of the orifice 25 is located in the first passage 7. A valve seat 26 is defined on the area surrounding the inlet. The valve member 27 is urged toward the valve seat 26 by the coil spring 29. The valve member 27 closes the orifice 25 when it abuts against the valve seat 26 and opens the orifice 25 when it is separated from the seat 26.

A controlling mechanism 14 is attached to the upper section of the main body 6. The controlling mechanism 14 is provided with an upper lid 16, a lower lid 18, and a film-like diaphragm 17 made of stainless steel and retained between the upper and lower lids 16, 18. A cylindrical coupling tube 18*a* is formed integrally with the lower lid 18 and is provided with a threaded outer surface 18*b*. A pressure chamber 11 is defined in the upper section of the main body 6 and connected with the third passage 9. The pressure chamber 11 opens at the upper surface of the main body 6 and has a threaded inner surface. The controlling mechanism 14 is attached to the upper section of the main body 6 by screwing the coupling tube 18*a* into the pressure chamber 11. An adhesive agent is applied to the coupled section to prevent the loosening of the coupling tube 18*a*.

A heat detecting chamber 10, in which saturated gas is sealed, is defined between the upper lid 16 and the diaphragm 17. A pipe 33 is brazed to the upper lid 16 to permit saturated gas to be charged into the detecting chamber 10. After charging the saturated gas, the distal end of the pipe is flattened to seal the detecting chamber 10. The pipe 33 is then permanently closed by soldering or the like to maintain the detecting chamber 10 in a sealed state.

A support hole 32 is formed in the generally center section of the main body 6 and is connected to the third passage 9. An elongated heat detecting rod 21, provided with an integrally formed flange 22 at its upper end, is supported by the inner surface of the coupling tube 18*a* at the flange 22 and slides in the longitudinal direction. The upper surface of the flange 22 is adhered to the diaphragm 17. The detecting rod 21 extends downward through the third passage 9 from inside the pressure chamber 11. The lower end of the detecting rod 21 is slidably supported by the support hole 32. An elongated actuating rod 24 is supported by the main body 6 and is movable in the longitudinal direction. The upper end of the actuating rod 24 abuts against the lower end surface of the detecting rod 21 and the lower end of the actuating rod 24 abuts against the valve member 27 through the orifice 25.

The liquefied refrigerant drawn into the first passage 7 from the condenser 2 via the receiver 3 expands as it passes through the orifice 25 and is thus converted into a low temperature, low pressure refrigerant mist. The refrigerant mist enters the second passage 8 and is then sent to the evaporator 5 to be gasified by the evaporator 5. The refrigerant gas is then sent to the compressor 1 via the third passage 9 of the expansion valve 4.

The refrigerant gas that passes through the third passage 9 flows into the pressure chamber 11. The temperature of the refrigerant gas in the third passage 9 and the pressure chamber 11 is transmitted to the saturated gas in the detecting chamber 10 through the detecting rod 21, the flange 22, and the diaphragm 17. Therefore, the saturated gas in the detecting chamber 10 expands or contracts in accordance with the temperature of the refrigerant gas passing through the third passage. The pressure inside the detecting chamber 10 is fluctuated by the expansion or contraction of the saturated gas. The diaphragm 17 is displaced upwards or downwards by the pressure fluctuation in the detecting chamber 10. The movement of the diaphragm 17 is transmitted to the valve member 27 through the detecting rod 21 and the actuating rod 24. As a result, the flow rate of the refrigerant mist drawn into the evaporator 5 is adjusted by controlling the area of the orifice 25 opened by the valve member 27 in accordance with the temperature of the refrigerant gas discharged from the evaporator 5 toward the compressor 1.

However, the expansion valve 4 of the prior art having the above-described structure has the following problems:

(1) Since the main body 6 of the expansion valve 4 in the prior art is made of metal, the thermal conductivity of the body 6 is high. Thus, the ambient temperature of the expansion valve 4 is apt to affect the temperature of the refrigerant gas in the pressure chamber 11 through the main body 6. An expansion valve is generally arranged inside an engine compartment, where the heat of the engine and other parts raises the temperature therein. Hence, when heat is transferred between the refrigerant inside the pressure chamber 11 and the saturated gas in the detecting chamber 10, the temperature of the saturated gas in the detecting chamber 10 may become greater than that of the refrigerant passing through the third passage 9. This results in inaccurate control of the area of the orifice 25 opened by the valve member 27 and thus hinders accurate adjustment of the flow rate of the refrigerant drawn into the evaporator 5. In addition, this may cause the valve member 27 to frequently open and close the orifice 25 resulting in frequent temperature fluctuation of the air in the passenger compartment.

(2) The high temperature, high pressure liquefied refrigerant drawn into first passage 7 is converted into low temperature, low pressure atomized refrigerant when it passes through the orifice 25 and flows into the second passage 8. However, the high thermal conductivity of the metal main body 6 permits a relatively high amount of heat transfer between the high temperature liquefied refrigerant in the first passage 7 and the low temperature atomized refrigerant in the second passage 8. This causes a loss of heat energy and degrades the cooling efficiency of the air-conditioning apparatus.

(3) The metal main body 6 is heavy. The expansion valve 4 is generally supported by pipes that are connected to the first, second, and third passages 7, 8, 9. However, the heavy weight of the expansion valve 4 causes vibration to apply a large load on the pipes and raises the possibility of damages inflicted on the pipes. In addition, manufacturing the main body 6 requires metal machining.

If the main body 6 were to be made of a synthetic resin material, the above problems (1) through (3) may be solved. However, since the strength of synthetic resin is low in comparison with metal, the valve seat 26 may be damaged due to repetitive contact with the valve member 27 against the resin seat 26. When the main body 6 is made of metal, the valve seat 26 is generally formed by pressing a steel spherical body, having the same dimension as the valve member 27, against the area surrounding the inlet of the orifice 25. By forming the valve seat 26 in this manner, the space between the valve member 27 and the valve seat 26 is completely sealed when the orifice 25 is closed. However, when the main body 6 is made of a synthetic resin material, the valve seat 26 may not be formed in the above manner. Therefore, a gap may exist between the valve member 27 and the valve seat 26 when the member 27 and seat 26 come into contact with each other, which will hinder complete sealing.

(4) The controlling mechanism 14 is attached to the main body 6 by screwing the threaded outer surface of the coupling tube 18*a* of the lower lid 18 into the inner surface of the pressure chamber 11. The lower lid 18 may be inexpensively formed through pressing. However, the threaded outer surface 18*b* of the coupling tube 18*a* must be machined and thus raises machining costs. Additionally, application of an adhesive agent is required to prevent the threaded outer surface 18*b* of the coupling tube 18*a* from becoming loose. Thus, this adds to the steps of the assembly operation.

(5) The lower end of the detecting rod 21 is supported by the support hole 32 formed in the main body 6, and the upper end of the rod 21 is supported by the inner surface of the lower lid's 18 coupling tube 18*a*, which is screwed to the main body 6. In other words, the lower end of the detecting rod 21 is directly supported by the main body 6 while the upper end section of the rod 21 is indirectly supported by the body 6 through the coupling tube 18*a*. It is difficult to align the support hole 32, directly formed in the main body 6, with the coupling tube 18*a*, screwed to the main body 6. This may hinder smooth movement of the detecting rod 21 and may thus interfere with the movement of the valve member 27.

The detecting rod 21 is formed by, for example, machining a cylindrical metal piece. The flange 22 is formed integrally with the upper end of the detecting rod 21. Thus, the outer diameter of the rod 21 differs between sections. This results in a large volume of material being machined for the section having a small diameter and causes a waste of material.

(6) The pipe 33, used to charge saturated gas into the detecting chamber 10 of the controlling mechanism 14, projects upward for a relatively long distance from the upper lid 16. Hence, when installing the expansion valve 4 into the refrigerating circuit, the pipe 33 may be deformed if it is hit against other parts in the engine compartment. This may damage the pipe 33 and cause leakage of saturated gas from the detecting chamber 10. To prevent this, it is necessary to reserve a large space in the engine compartment for the expansion valve 4.

To charge and seal the saturated gas in the detecting chamber 10, the pipe 33 brazed to the upper lid 16 is first washed. Saturated gas is then charged therethrough into the detecting chamber 10. Afterwards, the distal end of the pipe 33 is flattened and soldered. The sealing operation is difficult to automate and thus raises manufacturing costs.

SUMMARY OF THE INVENTION

Accordingly, it is an objective of the present invention to provide an expansion valve that is not affected by the ambient temperature, enables accurate controlling of the area of an orifice opened by a valve member, and has a light weight structure.

It is also an objective of the present invention to provide an expansion valve that completely seals the space between a valve member and a valve seat without damaging the seat when they come into contact with each other.

Another objective of the present invention is to provide an expansion valve having a controlling mechanism for the controlling of the valve member that is easily and securely attached to a main body.

A further objective of the present invention is to provide an expansion valve having a smoothly moving heat detecting rod.

Still, another objective of the present invention is to provide a compact expansion valve that is capable of easily and securely sealing saturated gas in a heat detecting chamber.

To achieve the above objects, the expansion valve according to the present invention includes a valve body, an adjusting mechanism for adjusting a flow rate of a refrigerant supplied to an evaporator and a control mechanism for controlling said adjusting mechanism in accordance with a temperature of the refrigerant supplied to a compressor from the evaporator. The body has a first passage for introducing the refrigerant to the body, a second passage for supplying the refrigerant from the first passage to the evaporator and a third passage for transferring the refrigerant to the compressor from the evaporator. The adjusting mechanism has a restriction for connecting the first passage with the second passage and a valve member for adjusting a degree of the restriction. The control mechanism has a heat sensitive chamber filled with the gas in a sealing manner and a diaphragm movable in accordance with pressure in the sensitive chamber. A transmitting member transmits the temperature of the refrigerant flowing in the third passage to the gas in the sensitive chamber and the movement of the diaphragm to the valve member. The body is made of a synthetic resin. A metal member is disposed in the body between the first passage and the second passage. The metal member has the restriction and a valve seat for contacting the valve member.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

FIG. 3(*b*) illustrates graphs showing the fluctuation of the pressures at the outlet of the condenser, the inlet of the evaporator, the outlet of the evaporator, and the temperature of the air sent into the passenger compartment from the evaporator when using a prior art expansion valve.

DETAILED DESCRIPTION OF THE PREFERRED EMBODIMENT

An expansion valve according to the present invention will now be described with reference to the drawings. Structural members which are identical to that of the prior art described above will be denoted with the same reference numbers and will not be described in detail.

Figure 1:
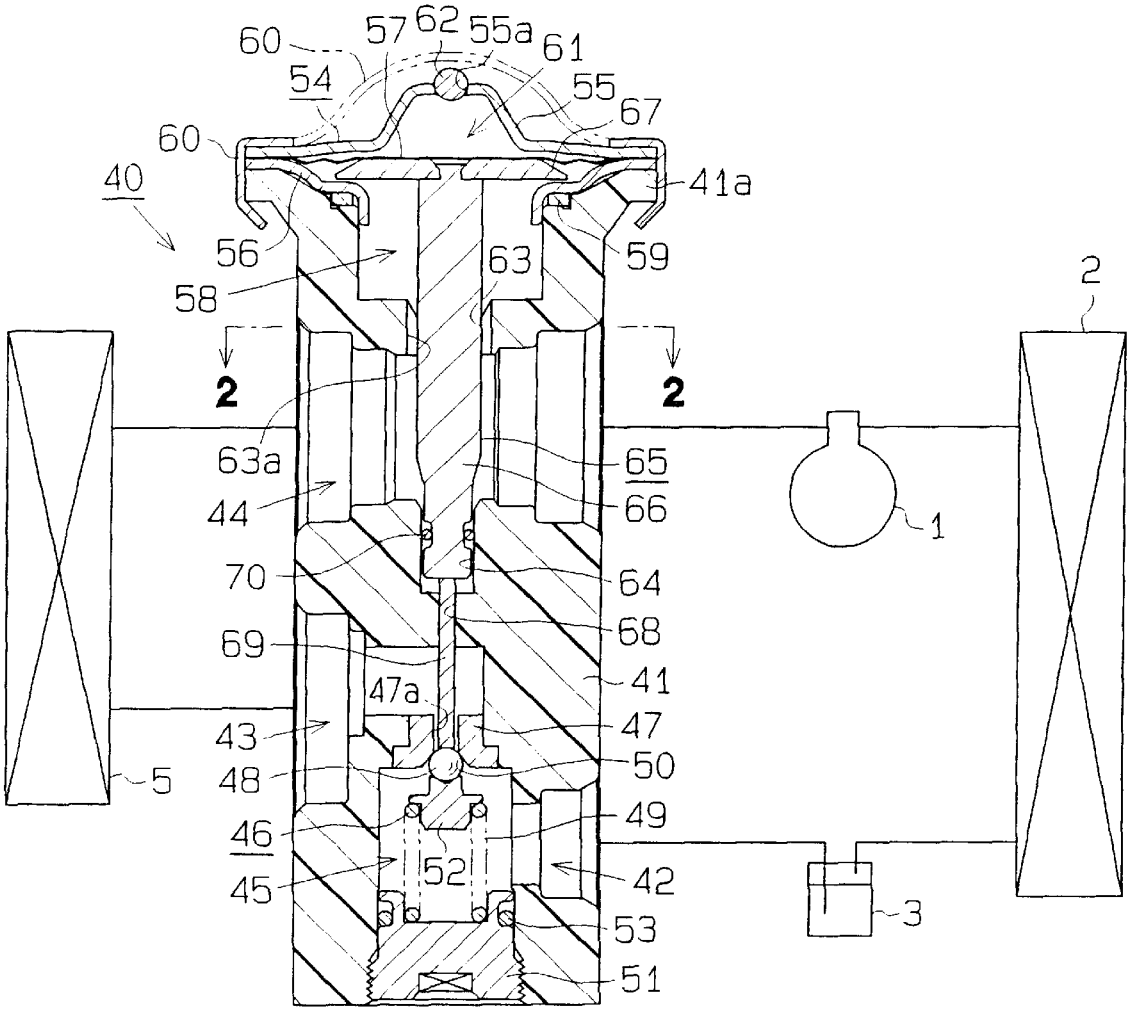
FIG. 1 is a cross-sectional side view showing an expansion valve according to the present invention installed in a refrigerating circuit of an automobile air-conditioning apparatus.

FIG. 1 is a cross-sectional side view showing an expansion valve 40 installed in a refrigerating circuit for an automobile air-conditioning apparatus. The expansion valve 40 includes a main body 41 made of a synthetic resin, a restricting mechanism 46, and a control mechanism 54. It is preferable that polyphenylene sulfide be used as the synthetic resin from which the main body 40 is made. Polyphenylene sulfide resin has high strength and superior heat resistance. In addition, polyphenylene sulfide does not deteriorate despite the existence of refrigerant and lubricating oil contained in the refrigerant. Another characteristic of this resin is that it deforms only slightly with temperature changes.

The main body 41 is provided with a first passage 42, which is connected to the outlet of the condenser 2 by way of the receiver 3, a second passage 43, which is connected to the inlet of the evaporator 5, and a third passage 44, which connects the outlet of the evaporator 5 with the inlet of the compressor 1. The restricting mechanism 46 is located in a valve chamber 45, which is defined inside the first passage 42.

The restricting mechanism 46 includes a metal member 47, in which an orifice 47*a* is formed, a valve member 48, and a coil spring 49. The metal member 47 is made from a material such as aluminum and fixed to the main body 6 between the first passage 42 and the second passage 43. The orifice 47*a* extends axially through the metal member 47 to connect the first passage 42 with the second passage 43. The inlet of the orifice 47*a* is located in the valve chamber 45. A valve seat 50 is defined on the area surrounding the inlet.

An adjusting screw 51, which also serves as a cap, is screwed into the bottom of the main body 41. The coil spring 49 is placed on the upper surface of the screw 51 in the valve chamber 45. The valve member 48 is mounted on the upper end of the coil spring 49 and urged toward the valve seat 50 by the spring 49. The orifice 47*a* is closed when the valve member 48 abuts against the valve seat 50 and opened when the member 48 is separated from the seat 50. The opened area of the orifice 47*a* is determined by the position of the valve member 48 with respect to the valve seat 50. A seal ring 53 is attached to the peripheral surface of the screw 51 to prevent leakage of refrigerant from the valve chamber 45.

The controlling mechanism 54 is attached to the upper section of the main body 41. The controlling mechanism 54 includes an upper lid 55, a lower lid 56, and a film-like diaphragm 57 made of stainless steel and retained between the upper and lower lids 55, 56. The peripheral sections of the upper and lower lids 55, 56 are welded to each other with the diaphragm 57 held in between. This secures the upper lid 55, the lower lid 56, and the diaphragm 57 integrally to one another. The main body 41 is provided with a flange 41*a* formed at its top peripheral section. A pressure chamber 58 is defined in the upper section of the main body 41 with an opening along the top surface of the body 41. The lower lid 56 of the controlling mechanism 54 is placed on the top surface of the main body 41 with a packing 59 provided in between. The peripheral surfaces of the controlling mechanism 54 and the flange 41*a* are encompassed by a cylindrical metal fastener 60. The upper and lower parts of the fastener 60 are crimped in this state to clamp the peripheral section of the controlling mechanism 54 and the flange 41*a*. In this manner, the controlling mechanism 54 is attached to the upper section of the main body 41.

Alternatively, as shown in the double dotted line of FIG. 1, the upper lid 55 may be totally encompassed by a dome-shaped fastener 60 that is formed through pressing.

A heat detecting chamber 61 is defined between the upper lid 55 and the diaphragm 57. Gas, such as HFC-134*a*, which is saturated, is charged into the detecting chamber 61 through an opening 55*a* formed in the center of the upper lid 55. A steel pellet 62 is then spot welded and fixed to the hole 55*a*. The detecting chamber 61 is sustained in a sealed state with the steel pellet 62 closing the opening 55*a*. Thus, the detecting chamber 61 is sealed with the saturated gas filled therein when the steel pellet 62 is spot welded and fixed to the opening 55*a*.

A first support hole 63 extends axially through the main body 41 between the pressure chamber 58 and the third passage 44. A second support hole 64 extends axially through the generally center section of the main body 41 and is connected to the third passage 44. The axes of the first and second support holes 63, 64 are aligned with the axis of the orifice 47*a*. A heat detecting rod 65 includes a shaft 66 and a flange 67 fixed to the upper end of the shaft 66. The detecting rod 65 extends downward through the third passage 44 from the pressure chamber 58. The shaft 66 is slidably inserted into and supported by the first and second support holes 63, 64 at its middle and lower sections. The upper surface of the flange 67 is adhered to the diaphragm 57.

Figure 2:
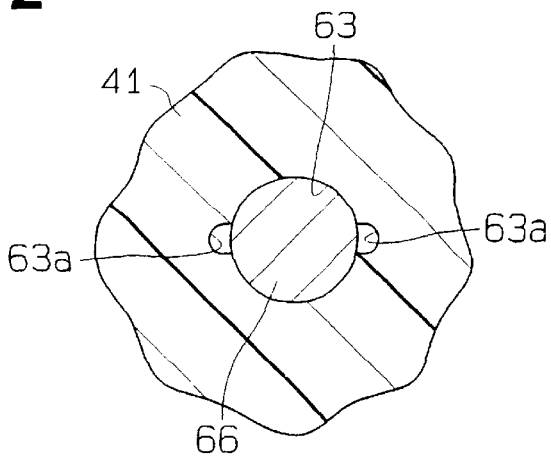
FIG. 2 is a partial enlarged cross-sectional view along the plane indicated by line 2—2 of FIG. 1.
Figure 3A:
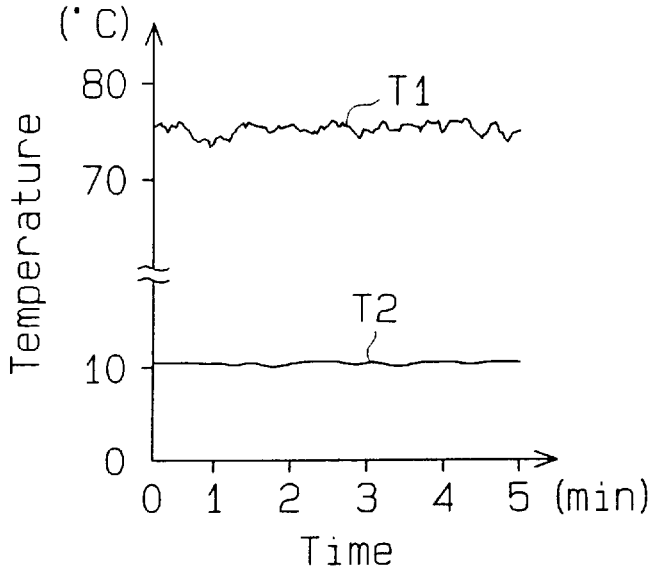
FIG. 3(*a*) illustrates graphs showing the fluctuation of the pressures at the outlet of the condenser, the inlet of the evaporator, the outlet of the evaporator, and the temperature of the air sent into the passenger compartment from the evaporator when using the expansion valve according to the present invention.
Figure 3A:
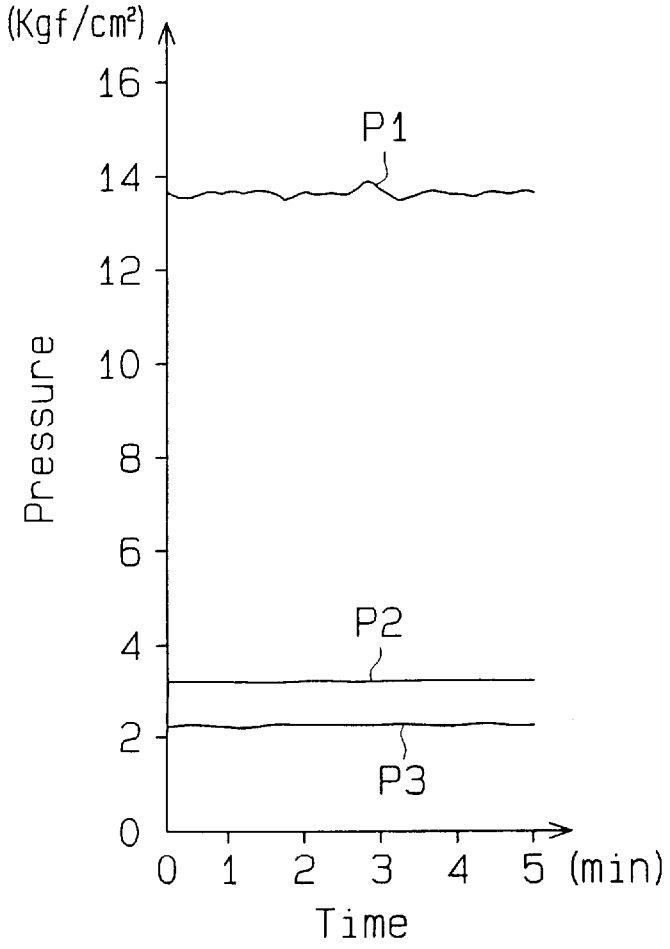
Figure 3B:
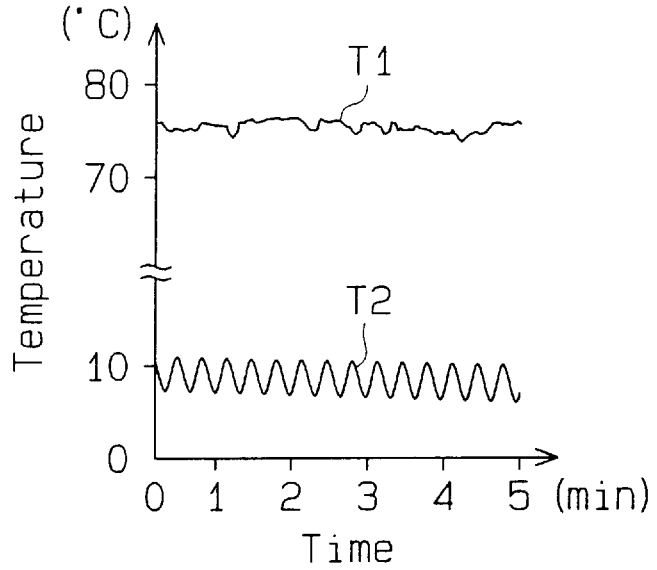
Figure 3B:
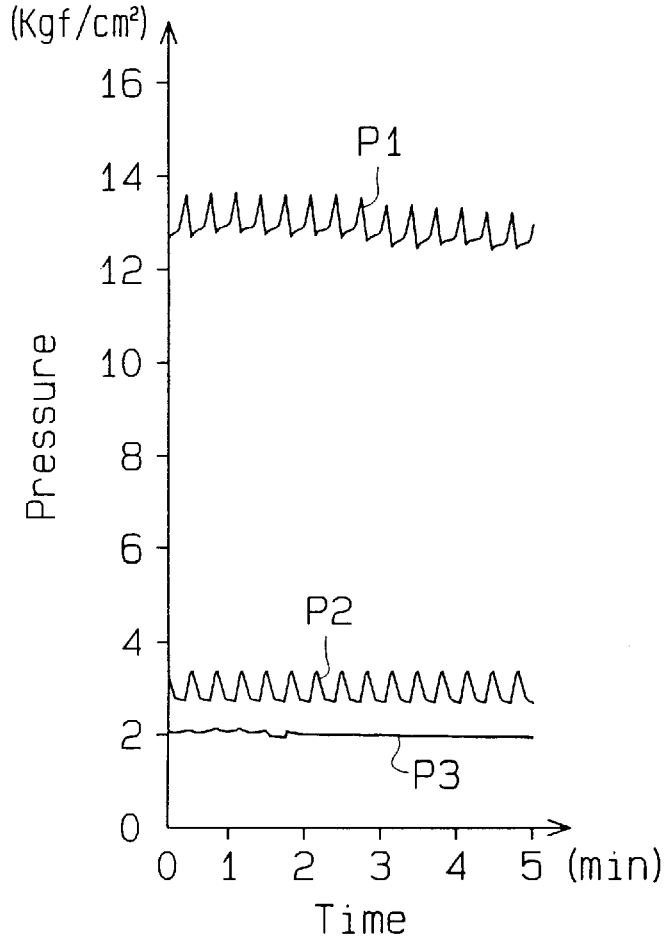
Figure 4:
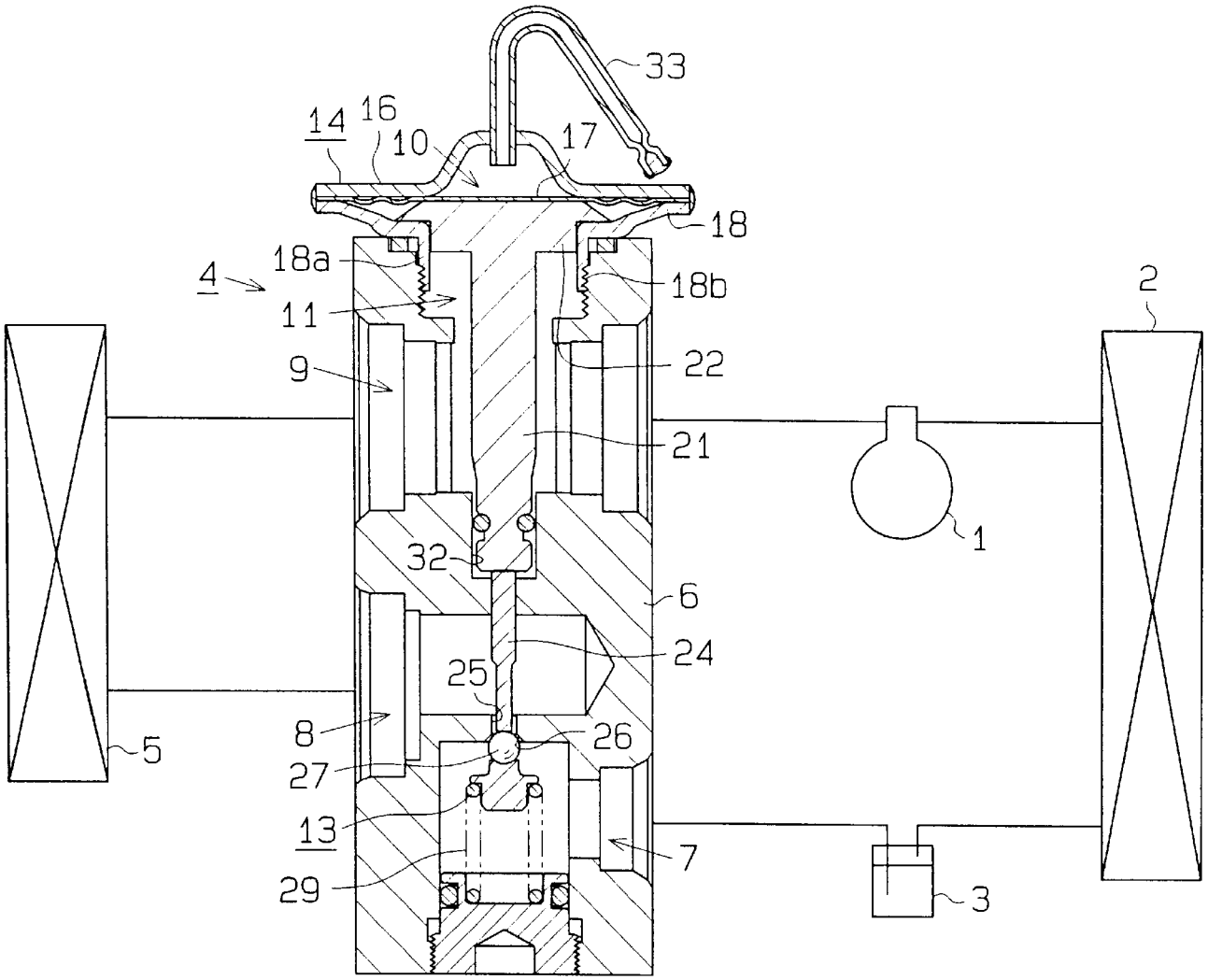
Fig.4 (Prior Art)
FIG. 4 is a cross-sectional view of a prior art expansion valve installed in a refrigerating circuit of an automobile air-conditioning apparatus.

As shown in FIGS. 1 and 2, a plurality of grooves 63*a* are formed in the inner surface of the first support hole 63 to connect the pressure chamber 58 with the third passage 44.

As shown in FIG. 1, a support hole 68 extends axially through the main body 41 between the bottom of the second support hole 64 and the second passage 43. The support hole 68 is aligned with the axis of the orifice 47*a*. An actuating rod 69 is supported by the support hole 68 and movable in the axial direction. The upper end of the actuating rod 69 abuts against the lower end surface of the detecting rod 65, and the lower end of the actuating rod 69 is abutted against the valve member 48 through the orifice 47*a*. A seal ring 70 is fitted on the lower outer surface of the shaft 66 of the detecting rod 65 to seal the space between the second and third passages 43, 44.

The operation of this device will now be described. The high temperature, high pressure gasified refrigerant, compressed by the compressor 1 is condensed and liquefied by the condenser 2. The liquefied refrigerant is then drawn into the first passage 42 of the expansion valve 40 via the receiver 3. In the first passage 42, the liquefied refrigerant is expanded as it passes through the orifice 47*a* and converted into a low temperature, low pressure atomized refrigerant. The atomized refrigerant drawn into the second passage 43 is sent to the evaporator 5. The evaporator 5 gasifies the atomized refrigerant. Afterwards, the gasified refrigerant is drawn into the compressor 1 via the expansion valve's 40 third passage 44.

When passing through the third passage 44, gasified refrigerant flows into the pressure chamber 58 through the grooves 63*a* of the first support hole 63. The detecting rod 65 is constantly urged upward by the coil spring 49 through the valve member 48 and the actuating rod 69. Thus, the position of the valve member 48 with respect to the valve seat 50 is maintained at a balancing point of the upward and downward forces acting on the detecting rod 65. The upward force acting on the detecting rod 65 is determined by the urging force of the coil spring 49 and the pressure within the pressure chamber 58, while the downward force is determined by the pressure within the detecting chamber 61.

The heat of the gasified refrigerant in the third passage 44 and the pressure chamber 58 is transmitted to the saturated gas inside the detecting chamber 61 by way of the detecting rod 65 and the diaphragm 57. This causes the saturated gas to expand or contract in the detecting chamber 61 in accordance with the temperature of the gasified refrigerant flowing through the third passage 44. The expansion and contraction of the saturated gas changes the pressure in the detecting chamber 61 and displaces the diaphragm 57 upwards or downwards. The displacement of the diaphragm 57 is transmitted to the valve member 48 through the detecting rod 65 and the actuating rod 69. Accordingly, the temperature of the gasified refrigerant sent to the compressor 1 from the evaporator 5 controls the area of the orifice 47*a*, opened by the valve member 48, and adjusts the flow rate of the atomized refrigerant drawn into the evaporator 5. In this manner, the degree of superheating of the gasified refrigerant at the outlet of the evaporator 5 is continually controlled at a constant value.

In this embodiment, the main body 41 of the expansion valve 40 is made of polyphenylene sulfide resin. Thus, the thermal conductivity of the main body 41 is one one-hundred-fiftieth (1/150) of that in the prior art expansion valve. Therefore, the ambient high temperature outside the expansion valve 40 does not effect the gasified refrigerant in the pressure chamber 58 and the temperature of the refrigerant in the pressure chamber 58 is generally maintained at the same value as the temperature of the refrigerant flowing through the third flow passage 44. Accordingly, the temperature of the saturated gas in the detecting chamber 61 is substantially the same as the temperature of the refrigerant flowing through the third passage 44 when the heat of the refrigerant in the pressure chamber 58 is transmitted to the saturated gas in the detecting chamber 61. In other words, heat is accurately transmitted between the saturated gas in the detecting chamber 61 and the refrigerant flowing through the third passage 44. Consequently, the area of the orifice 47*a* opened by the valve member 48 is accurately controlled and the flow rate of the refrigerant drawn into the evaporator 5 is thus accurately adjusted.

FIG. 3(*a*) shows a graph for the preferred embodiment illustrating the fluctuations of pressure P1, which is the pressure at the outlet of the condenser 2, pressure P2, which is the pressure at the inlet of the evaporator 5, pressure P3, which is the pressure at the outlet of the evaporator 5, and temperature T2, which is the temperature of the air sent into the passenger's compartment from the evaporator 5, under conditions where the expansion valve's 40 ambient temperature T1 is maintained at approximately 75 degrees Celsius. FIG. 3(*b*) shows a graph for the prior art expansion valve illustrating the fluctuations of the pressure P1, the pressure P2, the pressure P3, and the temperature T2 under conditions where the prior art expansion valve's 4 ambient temperature T1 is maintained at approximately 75 degrees Celsius.

It is apparent from FIG. 3(*b*) that the pressure P1 at the outlet of the condenser 2, the pressure P2 at the inlet of the evaporator 5, and the temperature T2 of the air sent into the passenger's compartment from the evaporator 5 frequently fluctuates when the prior art expansion valve 4 is used in high temperature conditions such as when the ambient temperature is approximately 75 degrees Celsius. This is caused by the frequent opening and closing of the valve member 27 resulting from the temperature of the saturated gas in the detecting chamber 10 becoming higher than the temperature of the refrigerant flowing through the third passage 9. In comparison, as shown in FIG. 3(*a*), the fluctuation of the pressures P1, P2, P3 and the temperature T2 is stabilized in spite of the ambient temperature T1 being kept at a high value, such as 75 degrees Celsius.

The main body 41 made of a synthetic resin having low thermal conductivity suppresses conduction of heat between the high temperature liquefied refrigerant in the first passage 42 and the low temperature atomized refrigerant in the second passage 43. As a result, the loss of heat energy is suppressed and the cooling efficiency of the air-conditioning apparatus is improved.

In addition, the main body 41, made of a synthetic resin, is only one half the weight of the prior art expansion valve 4, the main body of which is made of metal such as aluminum. This prevents damages inflicted on the pipes connected to the passages 42, 43, 44 that may be caused by vibration. Furthermore, the synthetic main body 41 allows a reduction in machining costs.

Although the main body 41 is made of a synthetic resin, the orifice 47*a* is formed in the metal member 47, which is fixed to the main body 41 and has a strength greater than the synthetic resin. This structure prevents damage to the valve seat 50 that may by caused by repetitive abutment of the valve member 48 against the seat 50. Furthermore, the valve seat 50 may be formed by pressing a steel spherical body, that has the same dimension as the valve member 48, against the area surrounding the inlet of the orifice 47*a*. Therefore, the space between the valve member 48 and the valve seat 50 is completely sealed when the member 48 contacts the seat 50 and the passage of the refrigerant is thus securely blocked.

The controlling mechanism 54 is attached to the main body 41 by crimping the metal fastener 60. Hence, thread machining and application of an adhesive agent, used to prevent loosening of the coupled parts, are not necessary according to the present invention whereas they were required in the prior art. This allows the controlling mechanism 54 to be easily and securely attached to the main body 41.

The detecting rod 65 is supported by the first and second support holes 63, 64. That is, the detecting rod 65 is directly supported by the main body 41 at its middle and lower section. The formation of the first and second support holes 63, 64 aligned along the same axis is rather simple. This leads to smooth movement of the detecting rod 65, which in turn allows smooth movement of the valve member 48.

The detecting rod 65 includes the shaft 66 and the flange 67 fixed to the top end of the shaft 66. The shaft 66 may be formed by machining a cylindrical piece of metal and the flange 67 may be formed by pressing a piece of metal. By coupling the shaft 66 and the flange 67 through crimping or other methods, the detecting rod 65 may be formed easily and economically. Furthermore, the shaft 66 and the flange 67 may be formed from different materials. This enables fine adjustment of thermal conduction in the detecting rod 65. In such cases, it is preferable that the shaft 66 be made of stainless while the flange 67 be made of aluminum or brass.

The steel pellet 62 is spot welded and fixed to the opening 55*a* in the upper lid 55 after charging the detecting chamber 61 with saturated gas through the opening 55*a*. By closing the opening 55*a* with the steel pellet 62, saturated gas is securely sealed in the detecting chamber 61. Accordingly, there are no parts projecting upward from the upper lid 55 and the size of the entire expansion valve 40 is compact. This allows positioning of the expansion valve 40 within a small space. Since, the direction of the steel pellet 62 with respect to the opening 55*a* is not limited when fixing the pellet 62 to the opening 55*a*, automation of the fixing process is rather simple. This facilitates the sealing operation of the saturated gas.

Although only one embodiment of the present invention has been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. An expansion valve for use in a refrigerant circuit of a compressor that compresses refrigerant supplied thereto from an evaporator and discharges the compressed refrigerant to a condenser, wherein said discharged refrigerant is supplied to the evaporator from the condenser by way of the expansion valve, said expansion valve comprising:

a valve body having a unitary hollow cylindrical shape and being entirely formed of thermally insulating synthetic resin, the valve body having a guide passage extending along the axis of the body and surrounded by thermally insulating synthetic resin, said body having a first passage for introducing the refrigerant to the body, a second passage for supplying the refrigerant from the first passage to said evaporator and a third passage for transferring the refrigerant to the compressor from the evaporator;

an adjusting mechanism positioned in the guide passage for adjusting a flow rate of the refrigerant supplied to the evaporator, said adjusting mechanism having a restriction for controllably connecting said first passage with said second passage and a valve member for adjusting a degree of the restriction;

a control mechanism for controlling said adjusting mechanism responsive to a temperature of the refrigerant supplied to the compressor from the evaporator, wherein said control mechanism includes a heat sensitive gas-filled, sealed chamber and a diaphragm movable in accordance with changes in pressure in the sensitive chamber, said sensitive chamber being exposed to the ambient atmosphere; and a metallic valve seat secured to an insulated wall between the first passage and the second passage to prevent the insulated wall from being damaged by contact with the valve member, said metallic valve seat having a hole extending therethrough along the axis of the body to form said restriction.

2. The expansion valve as set forth in claim 1 further including a single transmitting member for transmitting the temperature of the refrigerant flowing in the third passage to the gas in the sensitive chamber and the movement of the diaphragm to the valve member, wherein said body is opposed to the sensitive chamber with respect to the diaphragm and has a pressure chamber communicating with said third passage, and wherein said transmitting member extends through the pressure chamber and the third passage to transmit the heat of the refrigerant in the third passage and the pressure chamber to the gas in the sensitive chamber by way of the diaphragm.

3. The expansion valve as set forth in claim 1 further comprising:

said body having a flange;

fastener means for coupling said control mechanism to the body, said fastener means holding the control mechanism and the flange together; and an adjusting cap threadably mounted into the guide passage for adjustable supporting the adjusting mechanism and for sealing the guide passage.

4. The expansion valve as set forth in claim 3, wherein said control mechanism has an outer lid for defining the sensitive chamber in cooperation with the diaphragm and an inner lid for holding the diaphragm in cooperation with the outer lid, wherein said fastener means crimps the outer lid, the inner lid and the flange.

5. The expansion valve as set forth in claim 1, wherein said control member has a transmitting member for transmitting the temperature of the refrigerant flowing in the third passage to the gas in the sensitive chamber and the movement of the diaphragm to the valve member said transmitting member has a shaft-like shape, wherein said body has a first hole and a second hole for supporting the transmitting member in a slidable manner in an axial direction of the transmitting member.

6. The expansion valve as set forth in claim 5, wherein said first hole and said second hole are arranged opposite to each other with respect to the third passage on a line coincide to an axis of the transmitting member.

7. The expansion valve as set forth in claim 1 further comprising:

said control mechanism having a lid for defining the sensitive chamber in cooperation with the diaphragm, said lid having an opening for introducing the gas into the sensitive chamber; and a ball member for closing the opening to seal the gas in the sensitive chamber, said ball member being fixed to the lid by welding.

8. The expansion valve as set forth in claim 7, wherein said ball member fixed to the lid by spot welding.

9. The expansion valve as set forth in claim 1, wherein said body is made of said synthetic resin including polyphenylene sulfide.

10. The expansion valve as set forth in claim 2, wherein said transmitting member includes:

a shaft supported in the body and having an end, said shaft being arranged to be axially movable; and a dish member fixed to the end of the shaft so as to contact to the diaphragm.

11. The expansion valve as set forth in claim 10, wherein said dish member are respectively made of metal different from each other.

12. An expansion valve for use in a refrigerant circuit that compresses refrigerant supplied thereto from an evaporator and discharges the compressed refrigerant to a condenser, wherein said discharged refrigerant is supplied to the evaporator from the condenser by way of the expansion valve, said expansion valve comprising:

a valve body having a unitary hollow cylindrical shape and of thermally insulating synthetic resin, wherein a guide passage extends along the axis of the body and is surrounded by thermally insulating synthetic resin, said body having a first passage for introducing the refrigerant to the body, a second passage for supplying the refrigerant from the first passage to said evaporator and a third passage for supplying the refrigerant to the compressor from the adjusting mechanism extending into the guide passage for adjusting a flow rate of the refrigerant supplied to the evaporator, said adjusting mechanism having a restriction for controllably connecting said first passage with said second passage and a valve member for adjusting a degree of the restriction;

a control mechanism for controlling said adjusting mechanism in accordance with a temperature of the refrigerant supplied to the compressor from the evaporator, wherein said mechanism includes a heat sensitive gas-filled sealed chamber and a diaphragm movable in accordance with changes in pressure in the sensitive chamber, said sensitive chamber being exposed to the ambient atmosphere; and a metallic valve seat secured to an insulated wall between the first passage and the second passage to prevent the insulated wall from being damaged by contact with the valve member, said metallic valve seat having a hole extending therethrough along the axis to form said restriction; and a transmitting member for transmitting the temperature of the refrigerant flowing in the third passage to the gas in the sensitive chamber and the movement of the diaphragm to the valve member wherein said control mechanism, and wherein said valve body is opposed to the sensitive chamber with respect to the diaphragm and has a pressure chamber communicating with said third passage, and wherein said transmitting member extends through the pressure chamber and the third passage to transmit the heat of the refrigerant in the third passage and the pressure chamber to the gas in the sensitive chamber by way of the diaphragm.

13. The expansion valve as set forth in claim 12 further comprising:

said body having a flange; and fastener means for coupling said control mechanism to the body, said fastener means holding the control mechanism and the flange together.

14. The expansion valve as set forth in claim 13, wherein said control mechanism has an outer lid for defining the sensitive chamber in cooperation with the diaphragm and an inner lid for holding the diaphragm in cooperation with the outer lid, wherein said fastener means crimps the outer lid, the inner lid and the flange.

15. The expansion valve as set forth in claim 14 further comprising:

said first lid having an opening for introducing the gas into the sensitive chamber; and a metal ball member for closing the opening to seal the gas in the sensitive chamber, said metal ball member being fixed to the lid by spot welding.

16. The expansion valve as set forth in claim 12 further comprising:

said transmitting member including a shaft supported in the body and having an end, said shaft being arranged to be axially movable and a dish member fixed to the end of the shaft so as to contact to the diaphragm; and said body having a first hole and a second hole for supporting said shaft in a slidable manner in an axial direction of the shaft.

17. The expansion valve as set forth in claim 16, wherein said first hole and said second hole are arranged opposite to each other with respect to the third passage on a line coincide to an axis of the transmitting member.

18. The expansion valve as set forth in claim 17, wherein said shaft and said dish member are respectively made of metal materials different from each other.

19. The expansion valve as set forth in claim 12, wherein said body is made of said synthetic resin including polyphenylene sulfide.

* * * * *